US006584882B2

(12) United States Patent
Briggs et al.

(10) Patent No.: US 6,584,882 B2
(45) Date of Patent: Jul. 1, 2003

(54) SELF-CONTAINED CANISTER MISSILE LAUNCHER WITH TUBULAR EXHAUST UPTAKE DUCTS

(75) Inventors: David Conrad Briggs, Edgewood, MD (US); Jorge Igancio Ciappi, Bel Air, MD (US); William Russell Kraft, III, Forest Hill, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/767,084

(22) Filed: Jan. 22, 2001

(65) Prior Publication Data

US 2002/0096041 A1 Jul. 25, 2002

(51) Int. Cl.[7] ..... F41F 3/104
(52) U.S. Cl. ..... 89/1.817
(58) Field of Search ..... 89/1.817

(56) References Cited

U.S. PATENT DOCUMENTS

| | | | | | |
|---|---|---|---|---|---|
| 2,802,399 | A | * | 8/1957 | Little | 89/1.7 |
| 2,998,754 | A | * | 9/1961 | Bialy | 89/1.7 |
| 3,002,342 | A | * | 10/1961 | Schatzki | 60/35.54 |
| 3,167,016 | A | * | 1/1965 | Czerwinski et al. | 102/49 |
| 3,946,639 | A | * | 3/1976 | Sanvito et al. | 89/1.808 |
| 4,173,919 | A | * | 11/1979 | Piesik | 89/1.8 |
| 5,153,367 | A | | 10/1992 | Markquart et al. | 89/1.816 |
| 5,837,919 | A | | 11/1998 | Yagla et al. | 89/1.816 |
| 5,847,307 | A | | 12/1998 | Kennedy et al. | 89/1.817 |
| 6,079,310 | A | * | 6/2000 | Yagla et al. | 89/1.816 |
| 6,230,604 | B1 | * | 5/2001 | Larson et al. | 89/1.817 |

* cited by examiner

*Primary Examiner*—Michael J. Carone
*Assistant Examiner*—M. Thomson

(57) ABSTRACT

A self-contained missile canister includes a cylindrical shell having a plenum or manifold at the breech end for receiving and deflecting missile exhaust gases. A plurality of tubular exhaust ducts or uptake tubes route exhaust gases from the plenum to locations near the missile exit end of the canister. Protrusions on the missile, such as guide rails or aerodynamic control fins, extend from the missile body at locations lying between the exhaust ducts. The tubular exhaust ducts resist the exhaust pressure in hoop tension, so are lightweight. Ablative material may line the exhaust ducts. The exhaust ducts may be supported by longitudinally disposed support beams, preferably I-beams. In one embodiment, each I-beam supports two exhaust ducts.

12 Claims, 6 Drawing Sheets

SELF-CONTAINED CANISTER MISSILE LAUNCHER WITH TUBULAR EXHAUST UPTAKE DUCTS

FIELD OF THE INVENTION

This invention relates to self-contained missile canisters, and more particularly to such canisters which include ducting for reversing the direction of exhaust gases and venting in the forward direction.

BACKGROUND OF THE INVENTION

The use of rocket-powered missiles for warfare is at least two hundred years old. As missiles have become more sophisticated, the need for protection of the missiles against weather and damage has led to the use of missile canisters, which can be transported and stored with little danger of damage to the missile or missiles contained therein, and from which the missile may be launched. Some early forms of such canisters were not fully weathertight, and U.S. Pat. No. 5,153,367, issued Oct. 6, 1992 in the name of Markquart et al. describes a cocoon for protecting a rectangular missile canister having an open launch or exhaust end from the environment. The Markquart et al. cocoon can be mounted on a structure to tilt it to the angle desired for launch. An exhaust system is associated with the cocoon for deflecting the exhaust gases by angles greater or less than 90°. As noted in the Markquart et al. patent, the cocoon provides for a simpler structure than that required for vertical launch from within a ship, because vertical launch requires that the exhaust gases be routed from the interior of the launch ship to the exterior. It should be noted that more recent canisterized missiles are more completely sealed against the environment than early missiles, and include frangible or other end seals which rupture or open when the missile is fired, to thereby allow the missile to exit the front end of the canister, and exhaust gases to exit the rear of the canister. Such an arrangement protects the missile until the last possible moment at which the missile is launched from the container.

U.S. Pat. No. 5,847,307, issued Dec. 8, 1998 in the name of Kennedy et al. describes a ship-borne vertical launch arrangement for canisterized missiles. The structure includes a framework defining elongated rectangular receptacles, each of which is dimensioned to accommodate one missile canister. At the bottom end of the multiple-receptacle structure, a plenum or manifold interconnects all of the receptacles. When the structure is loaded with missile canisters, at least one of the receptacles is left without a missile canister, and firing of any of the missiles causes the exhaust from that missile to be routed through the open receptacle to the top side or exterior of the ship. Firing of other missiles after the first allows the exhaust gas to be further routed through a now-empty or open canister as well as through the open receptacle. Erosion of the plenum is reduced by water injection.

U.S. Pat. No. 5,837,919, issued Dec. 8, 1998 in the name of Yagla et al. describes a portable launcher for a missile. The portable launcher includes an inner missile holding structure concentric with a cylindrical outer structure, with an annulus or annular interstice lying between the inner and outer structures. A plenum is defined at the rear or missile-exhaust end of the structure, which routes the exhaust gases from the inner missile holding structure through the annular interstice to the front of the portable launcher. The inner and outer structures are held in fixed relation by supports extending therebetween. In some embodiments, the supports are arranged to provide clearance for projecting portions of the missile, such as for example aerodynamic fins.

Improved missile canister arrangements are desired.

SUMMARY OF THE INVENTION

A self-contained missile canister according to an aspect of the invention includes a missile which is elongated about an axis. The missile has an axially projected body shape which includes a circular portion and projections extending beyond the radius of the circular portions at plural circumaxial positions. In this context, a circumaxial position is an angular position or range measured from a reference angle in a circumferential manner about a point along the axis. The self-contained missile canister includes an elongated canister storage and launch duct defining a missile exit end and a rear or breech end. The storage and launch duct has a circular cross-sectional shape and a cross-sectional diameter which is larger than the largest cross-sectional diameter of the missile at the projections, whereby a plurality of elongated regions lie between the missile and the interior of the storage and launch duct over circumaxial regions other than the plural circumaxial positions of the missile. A plenum is affixed to the breech end of the canister storage and launch duct, for deflecting exhaust gases generated by the missile within the storage and launch duct during launch. A plurality of elongated, tubular exhaust ducts lie adjacent the interior of the canister storage and launch duct within the circumaxial regions other than the plural circumaxial positions of the missile. Each of the exhaust ducts has a circular cross-section, and each of the exhaust ducts of set 36 is coupled to the plenum for receiving the exhaust gases from the plenum. In addition, each of the exhaust ducts of set 36 extends from the plenum to at least near the missile exit end of the storage and exhaust duct, for routing the exhaust gases deflected by the plenum to the missile exit end of the storage and launch duct. In a particular self-contained missile canister according to the invention, the axially projected body shape is roughly square, thereby providing four circumaxial regions other than the plural circumaxial positions of the missile.

In a particularly advantageous version of the self-contained missile canister according to the invention, a plurality of elongated support beams are provided, each extending along at least a portion of the length of the storage and launch duct within one of the circumaxial regions other than the plural circumaxial positions of the missile. In a desirable avatar of the invention, each of the elongated support beams supports at least one of the exhaust ducts, and preferably two exhaust ducts. The support beams are preferably I-beams defining two flanges and a web, with one of the flanges affixed to the interior wall of the storage and launch duct. When an I-beam is used to support one or more exhaust ducts, the web of the I-beam is preferably concave on the side facing the exhaust duct being supported, so as to tend to provide an area support. In one embodiment, most of the exhaust ducts are paired for support by I-beams. To save weight, the material of the exhaust ducts may be reinforced composite material. An ablative lining may be employed with the exhaust ducts to prevent burn-through of the walls of the duct.

Taking another view of the invention, a self-contained missile canister includes a missile having a body which has at least some cross-sections which are generally circular, and which may also include cross-sections which exhibit projecting portions extending beyond the largest of the generally circular cross-sections, whereby a projection of the shape of the missile body, with its projecting portions, onto a plane orthogonal to an axis of the missile defines an exterior shape. An elongated canister storage and launch duct defines a longitudinal axis, a missile exit end, and a rear or breech end. The storage and launch duct has a circular internal cross-sectional shape at least near the missile exit end which clears the exterior shape of the missile, whereby space is available between the exterior of the missile and the interior of the storage and launch duct at locations removed from the projecting portions. A plenum is affixed to the rear or breech end of the storage and launch duct, for deflecting exhaust gases generated by the missile within the storage and launch duct. A plurality of elongated, tubular exhaust ducts lie at least partially within the space with their axes parallel to the longitudinal axis of the storage and launch canister. Each of the exhaust ducts is coupled to the plenum, and extends to at least near the missile exit end of the storage and exhaust duct, for routing the exhaust gases deflected by the plenum to the missile exit end of the storage and launch duct. The projecting portions of the missile body may include aerodynamic fins, which may be disposed by equal angular increments about an axis of the missile. Ablative material may be used within the exhaust ducts of set or the entire exhaust duct may be made from ablative material. In this context, reinforced composite material may be viewed as ablative material.

DESCRIPTION OF THE INVENTION

Figure 1A:
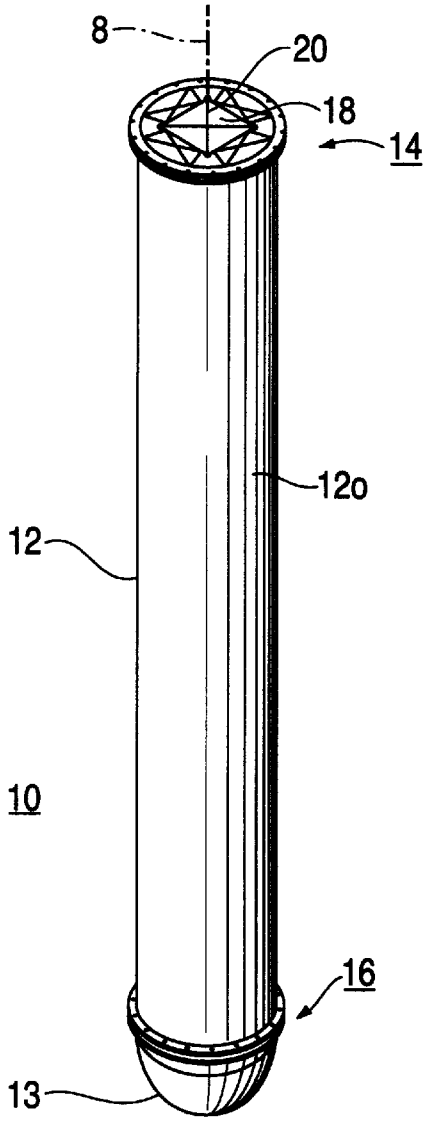
FIG. 1*a* is a simplified perspective or isometric illustration of the exterior of a missile canister according to an aspect of the invention, illustrating a frangible cover covering the front end of the canister and a plenum or manifold at the rear or breech end.

In FIG. 1*a*, a self-contained missile canister 10 according to an aspect of the invention includes a cylindrical exterior shell or wall 12 centered on an axis 8. Exterior wall 12 defines a missile exit or "front" end 14, a "rear" end 16 and an exterior or outer surface 12*o*. The exterior surface 12*o* defining within its interior a storage and launch duct. The front end 14 of the missile canister 10 is protected by a breakable or frangible cover 18, which has one or more weak regions or lines 20 which tend to control the shape and course of breaking of the frangible cover when the missile exits. FIG. 1*a* also illustrates a hemispherical plenum or manifold 13 bolted to the rear portion of the shell 12 of self-contained missile canister 10.

Figure 1B:
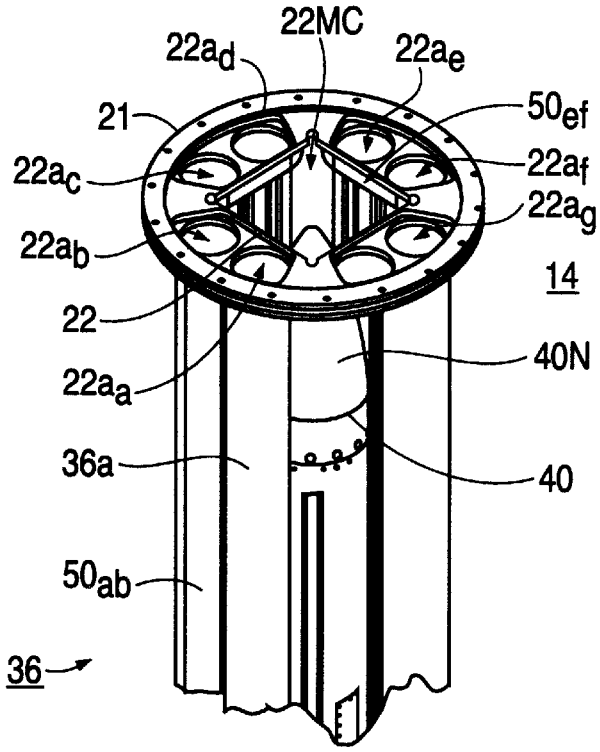
FIG. 1*b* is a simplified perspective or isometric view of the front end of the missile canister of FIG. 1*a* with the frangible cover and the canister shell removed to illustrate interior details.

In FIG. 1*b*, the front end 14 of missile canister 10 is illustrated without the frangible cover (18 of FIG. 1*a*), to thereby illustrate an interior portion of self-contained missile canister 10, in which the nose end 40*n* of a missile 40 may be seen. A forward cover annulus 21 holds down the frangible cover (not illustrated in FIG. 1*b*) to an uptake alignment plate 22. Uptake alignment plate 22 is peripherally affixed to the shell (not illustrated in FIG. 1*b*), and provides a missile clearance aperture 22MC, together with a plurality of apertures into which other portions of the internal structure of the self-contained missile canister 10 fit, for proper alignment thereof. Among the internal structures which are aligned by uptake alignment plate 22 is an exhaust duct 36*a*, which is part of a set 36 of exhaust ducts. The upper end of exhaust duct 36*a* is fitted into a circular aperture $\mathbf{22}a_a$ in uptake alignment plate 22. Other corresponding apertures include $\mathbf{22}a_b$, $\mathbf{22}a_c$, $\mathbf{22}a_d$, $\mathbf{22}a_e$, $\mathbf{22}a_f$ and $\mathbf{22}a_g$, each of which is intended for support of a corresponding exhaust duct of set 36 of exhaust ducts. FIG. 1*b* also illustrates guide rail support brackets $\mathbf{50}_{ab}$ and $\mathbf{50}_{ef}$ of a set 50 of four guide rails.

Figure 1C:
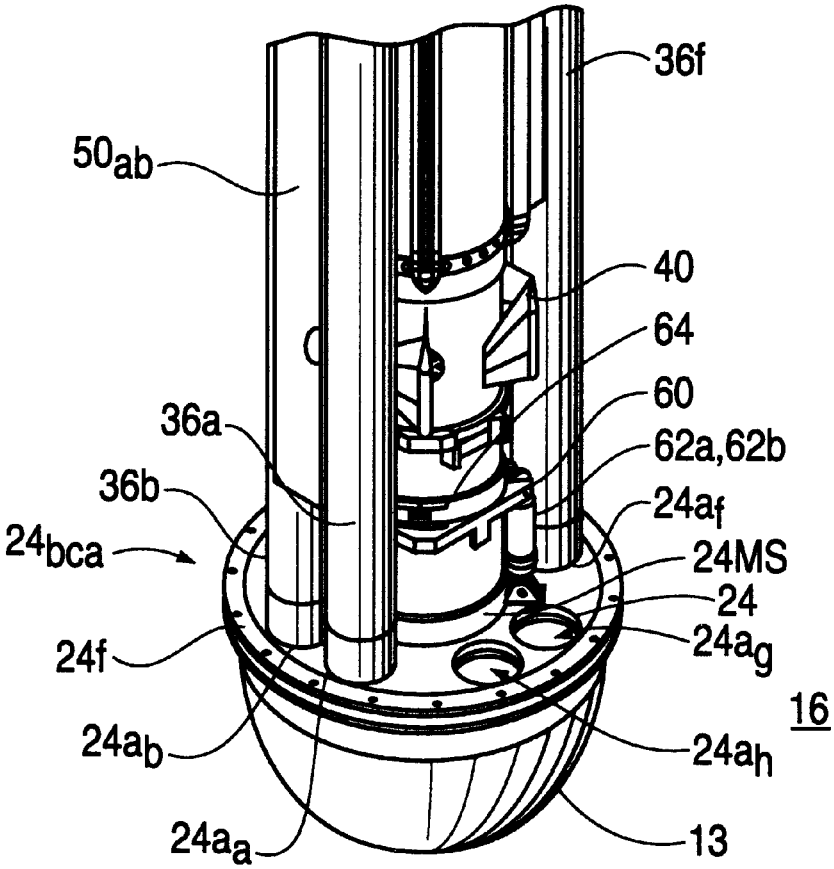
FIG. 1*c* is a perspective or isometric view of the rear portion of the missile canister of FIG. 1*a* with the canister shell removed to reveal interior details.
Figure 1D:
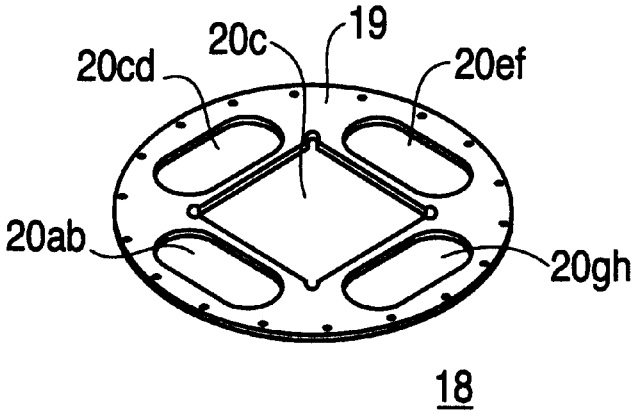
FIG. 1*d* is a perspective or isometric view of the frangible cover.

In FIG. 1*c*, the lower or breech portion 16 of the self-contained missile canister 10 includes a metallic baseplate 24. Baseplate 24 includes a flange portion 24*f* defining a plurality of peripheral bolt clearance apertures of a set $\mathbf{24}_{bca}$ of bolt clearance apertures (not separately designated) which allow bolt attachment of the hemispherical plenum 13. Baseplate 24 also includes a set 24*a* of indexing or alignment apertures including aperture $\mathbf{24}a_a$ which is registered with the bottom end of exhaust duct 36*a*, aperture $\mathbf{24}a_b$ which is registered with exhaust duct $\mathbf{36}_b$, and aperture $\mathbf{24}a_f$ which is registered with the lower end of exhaust duct $\mathbf{36}_f$. In addition, baseplate 24 of FIG. 1*c* illustrates further apertures $\mathbf{24}a_g$ and $\mathbf{24}a_h$, registered with additional ones of the exhaust ducts of set 36. Details of the mounting of exhaust ducts to the baseplate 24 are further illustrated in FIG. 1*e*. FIG. 1*d* shows the cover end wherein the frangible cover 18 is formed of a guide plate 19 having a central opening 20*c* and openings 20*ab*, 20*cd*, 20*ef* and 20*gh*. The self-contained missile canister has been so far described as having provision for eight exhaust ducts or uptake tubes of set 36.

Figure 1E:
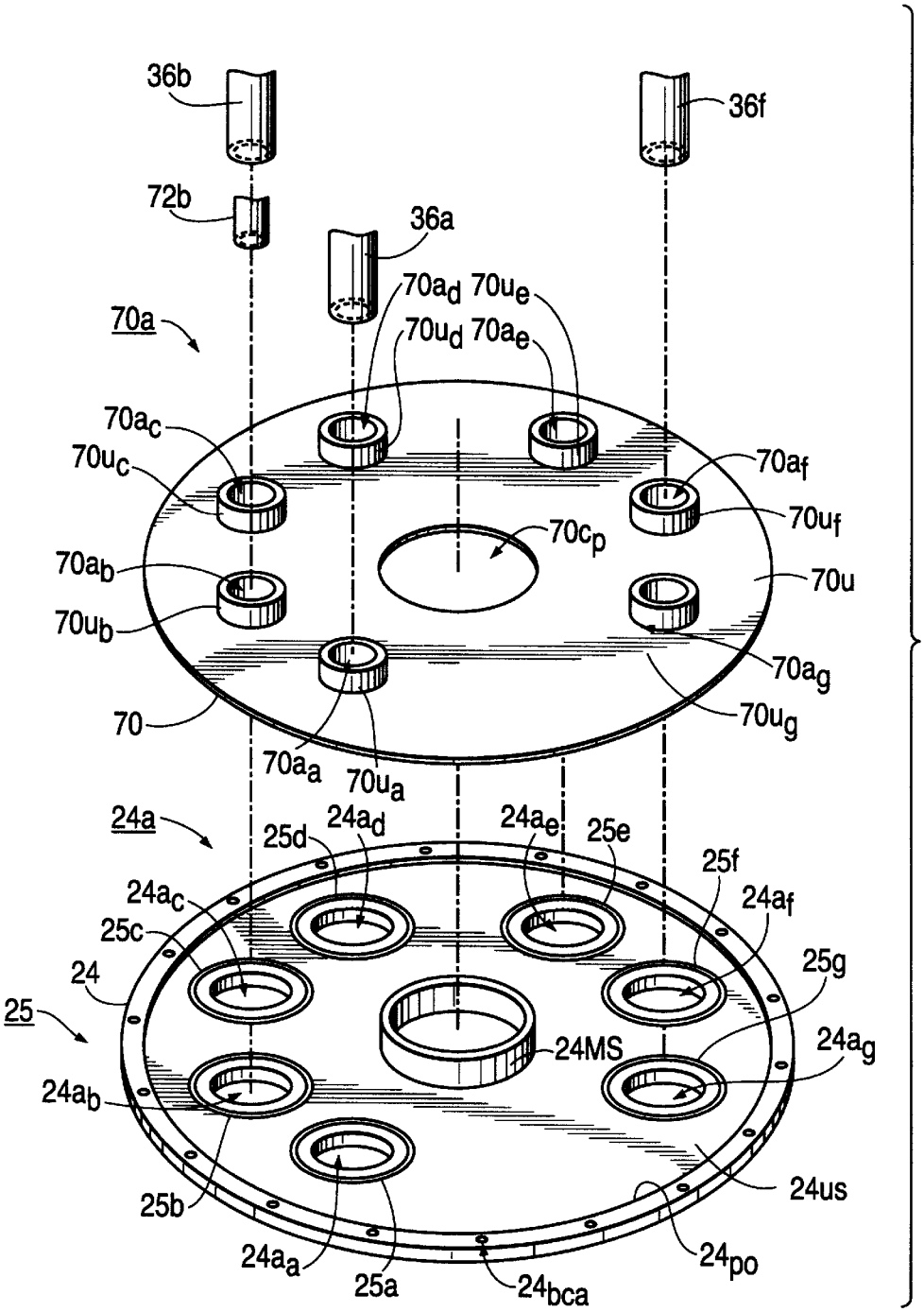
FIG. 1*e* is a simplified exploded perspective or isometric view of a portion of the structure of FIG. 1*c;*

In FIG. 1*e*, the baseplate 24 is seen exploded away from a "false plate" 70 and some of the exhaust ducts of set 36 of exhaust ducts. Elements of FIG. 1*e* corresponding to those of FIGS. 1*b* and 1*c* are designated by like reference alphanumerics. As illustrated in FIG. 1*e*, the baseplate 24 defines a set 24*a* of seven apertures $\mathbf{24}a_a$, $\mathbf{24}a_b$, $\mathbf{24}a_c$, $\mathbf{24}a_d$, $\mathbf{24}a_e$, $\mathbf{24}a_f$, and $\mathbf{24}a_g$, rather than the eight apertures illustrated in FIGS 1*b* and 1*c*. The deletion of one exhaust duct or uptake tube from eight-duct set 36 advantageously leaves room for ancillary equipment. Surrounding each of the seven apertures of set 24*a* is an O-ring of a set 25, set into a groove. More particularly, an O-ring 25*a* surrounds aperture $\mathbf{24}a_a$, an O-ring 25*b* surrounds aperture $\mathbf{24}a_b$, an O-ring 25*c* surrounds aperture $\mathbf{24}a_c$, an O-ring 25*d* surrounds aperture $\mathbf{24}a_d$, an O-ring 25*e* surrounds aperture $\mathbf{24}a_e$, an O-ring 25*f* surrounds aperture $\mathbf{24}a_f$, and an O-ring 25*g* surrounds aperture $\mathbf{24}a_g$. In addition, a large peripheral O-ring $\mathbf{24}_{PO}$ lies in a groove extending peripherally around the upper surface 24*us* of baseplate 24, just within the ring of bolt clearance apertures of set $\mathbf{24}_{bca}$. Peripheral O-ring $\mathbf{24}_{PO}$ is dimensioned to set against an end portion of canister body 12 to seal the baseplate-to-canister connection against ingress of moisture or dirt during storage, and may also help to prevent egress of gases during missile firing. Also illustrated in FIG. 1*e* is a "false plate" 70 made of a lightweight material such as fiber-reinforced epoxy. False plate 70 has a diameter smaller than the diameter of O-ring $\mathbf{24}_{PO}$, so that when false plate 70 is mounted against the upper surface of baseplate 24, it lies within the canister body 12. As illustrated in FIG. 1*e*, false plate 70 defines a central aperture 70*cp* dimensioned to clear the upright missile support collar 24MS of baseplate 24, so that the lower surface of false plate 70 can fit flush against the upper surface of baseplate 24, as a result of which each O-ring of set 25 of O-rings bears against the lower surface of false plate 70 surrounding one aperture of set 24 of apertures. More particularly, when false plate 70 is mounted on baseplate 24, O-ring 25*a* seals the gap between aperture $\mathbf{24}a_a$ in baseplate 24 and aperture $\mathbf{70}a_a$ in false plate 70, O-ring 25*b* seals the gap between aperture $\mathbf{24}a_b$ in baseplate 24 and aperture $\mathbf{70}a_b$ in false plate 70, and similarly O-ring 25*c* seals the gap between aperture $\mathbf{24}a_c$ and aperture $\mathbf{70}a_c$, O-ring 25*d* seals the gap between aperture $\mathbf{24}a_d$ and aperture $\mathbf{70}a_d$, O-ring 25*e* seals the gap between aperture $\mathbf{24}a_e$ and aperture $\mathbf{70}a_e$, O-ring 25*f* seals the gap between aperture $\mathbf{24}a_f$ and aperture $\mathbf{70}a_f$, and O-ring 25*g* seals the gap between aperture $\mathbf{24}a_g$ and aperture $\mathbf{70}a_g$.

As illustrated in FIG. 1*e*, each exhaust aperture of set 70*a* of exhaust apertures of false plate 70 is associated with an upright peripheral collar of a set 70*u* of collars on the upper surface of false plate 70 Thus, an upright peripheral collar $\mathbf{70}u_a$ surrounds aperture $\mathbf{70}a_a$, an upright peripheral collar $\mathbf{70}u_b$ surrounds aperture $\mathbf{70}a_b$, an upright peripheral collar $\mathbf{70}u_c$ surrounds aperture $\mathbf{70}a_c$, an upright peripheral collar $\mathbf{70}u_d$ surrounds aperture $\mathbf{70}a_d$, an upright peripheral collar $\mathbf{70}u_e$ surrounds aperture $\mathbf{70}a_e$, an upright peripheral collar $\mathbf{70}u_f$ surrounds aperture $\mathbf{70}a_f$, and an upright peripheral collar $\mathbf{70}u_g$ surrounds aperture $\mathbf{70}a_g$. The exhaust ducts or exhaust tubes of set 36 of exhaust ducts are fitted into the collars of set 70*u*, and are fastened in place, as by adhesive or epoxy bonding. In FIG. 1*e*, the lower end of exhaust duct or exhaust tubes 36*a*, 36*b*, and 36*f* are illustrated as mating with the collars $\mathbf{70}u_a$, $\mathbf{70}u_b$, and $\mathbf{70}u_f$, respectively. It will be clear that the other exhaust ducts which are not illustrated in FIG. 1*e* are similarly mounted and affixed within the remaining upright collars of set 70*u*.

According to an aspect of the invention, the interior walls of the exhaust ducts or tubes of set 36 of exhaust ducts are lined with ablative material. The lining with ablative material has the salutary effect of allowing the use of lightweight composite material for the exhaust duct supports, without the possibility of burn-through of the ducts. Metal could be used as the exterior duct material, but when made thin so as to reduce weight, may also require the use of an ablative liner. A portion of the ablative liner associated with exhaust duct 36*b* is illustrated as 72*b* in FIG. 1*e*. Each of the other exhaust ducts is similarly lined. A major advantage of the use of tubular exhaust ducts or uptake tubes is that such tubes resist the exhaust pressure in hoop tension mode, and so deform less than ducts of noncircular cross-section of the same thickness, or alternatively may be made of thinner material than would be required for a noncircular duct for an equivalent amount of deformation.

As illustrated in FIG. 1*c*, guide rail support bracket $\mathbf{50}_{ab}$ of guide rail set 50 lies adjacent both exhaust ducts 36*a* and 36*b*. Also in FIG. 1*c*, a missile base structure designated 60 is supported away from canister base plate 24 and missile support collar 24MS by a pair of "liquid springs" or dampers 62*a*, 62*b*, which allow the missile base plate 60 to move somewhat axially under impact, relative to a missile support portion 24MS of the missile canister baseplate 24. A Marmon clamp 64 controllably connects the missile 40 to the missile base structure 60.

Figure 2A:
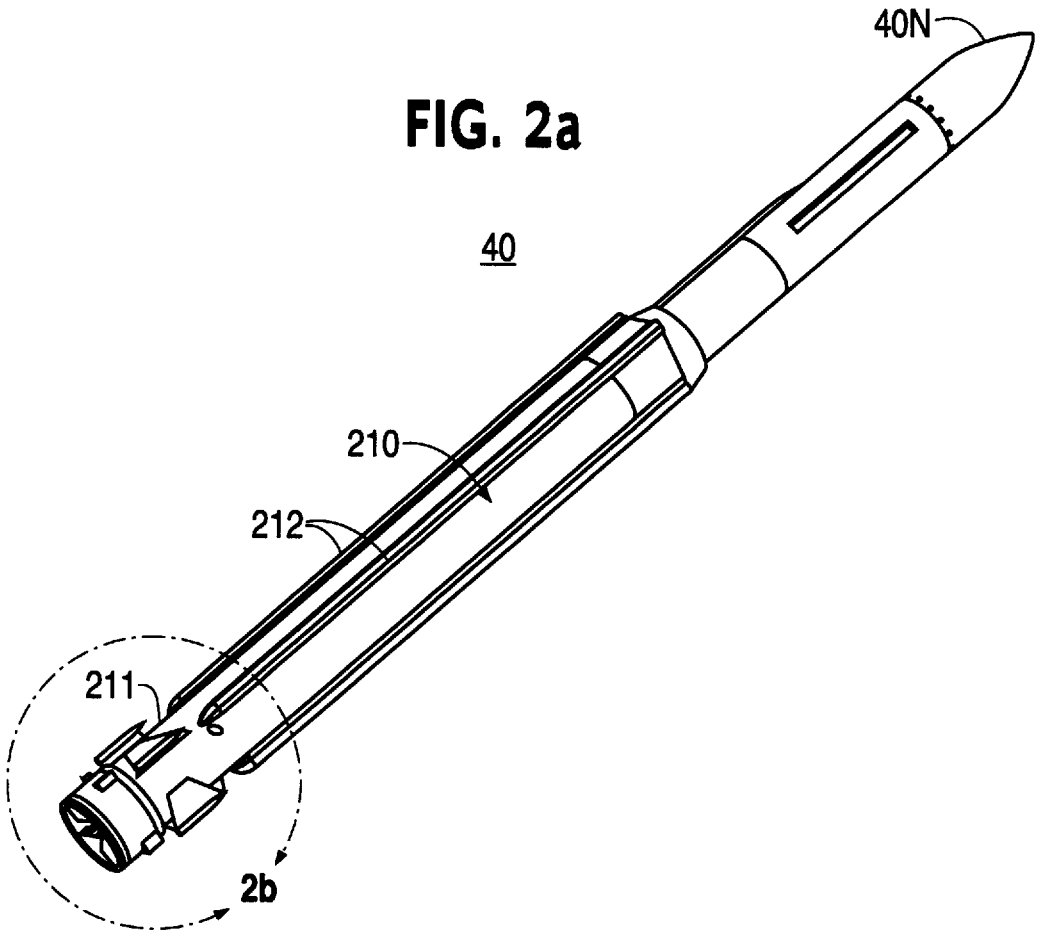
FIG. 2*a* is a overall view of a missile for use in the arrangement of FIG. 1*a*.
Figure 2B:
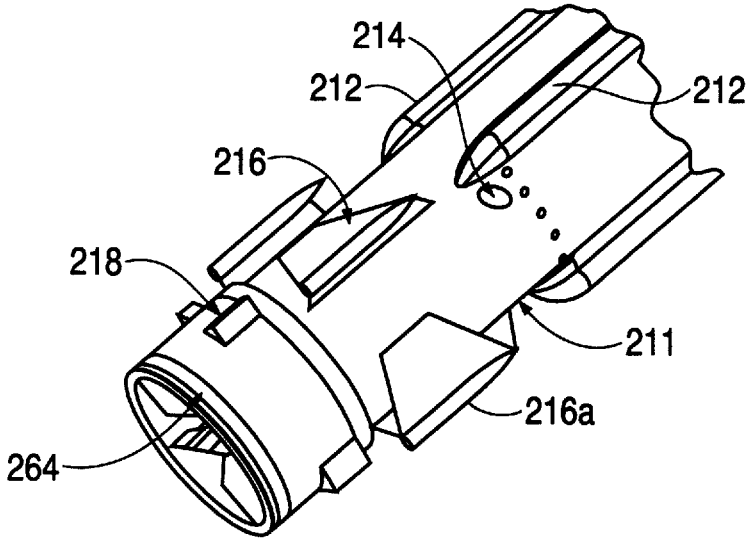
FIG. 2*b* is a detail of the thruster end thereof.

FIG. 2*a* illustrates a general view of an ESSM missile, and FIG. 2*b* illustrates details of the rearmost portion of the missile. In FIG. 2*a*, the missile body is designated 210. The missile body 210 is generally circular over most of its length, but defines four elongated rails, one of which is designated 212, over a portion of the length. Near the aft or rear end of the missile, a socket for an umbilical connector is designated 214. Aft of the umbilical connector 214 lies a set 216 of four control surfaces or fins, one of which is designated 216*a*. These fins are folded during storage, and are deployed when the missile is launched. Aft of the control surface set 216 is an anti-rotation guide 218, having two bosses per place or location, to prevent missile axial rotation while it exits the canister (mainly due to thrust misalignment), thus avoiding any unwanted contact between the missile and any non-contacting or non-guiding canister surfaces. The rearmost portion of the missile of FIGS. 2*a* and 2*b* is associated with an interface 264 to the Marmon clamp 64 of FIG. 1*c*.

Figure 3A:
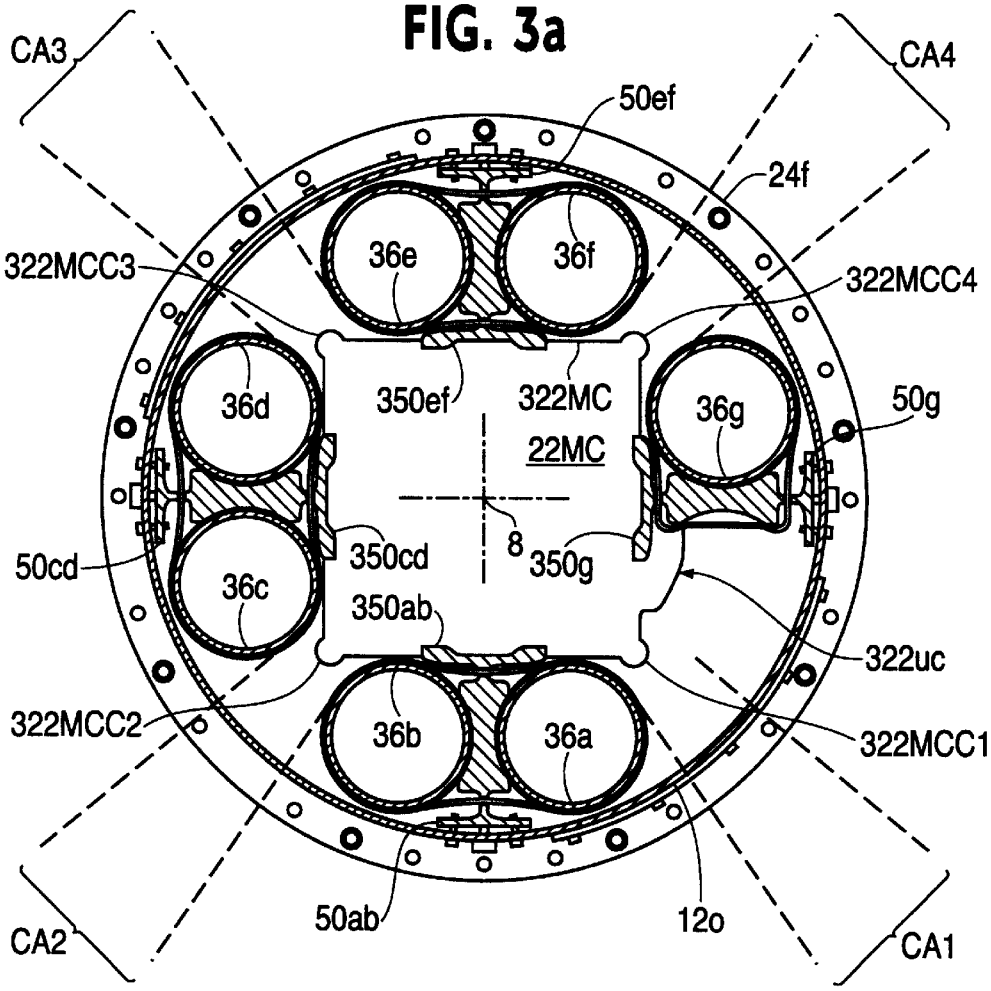
FIG. 3*a* is a simplified cross-sectional view, looking aft, of a missile canister.

FIG. 3*a* is a simplified cross-sectional view, looking aft, of a missile canister 12 (without missile) having seven exhaust ducts. In FIG. 3*a*, the lower baseplate flange portion 24*f* with its bolt clearance apertures can be seen. The approximately square outline 322MC of the missile clearance aperture 22MC can also be seen, together with the asymmetrical aperture portion 322*uc* for umbilical clearance. The roughly square outline of the missile clearance aperture results from the combination of a generally circular missile body together with four protruding control surfaces or fins, with the protruding fin locations corresponding to the corners 322MCC1, 322MCC2, 322MCC3, and 322MCC4. These four corners, in conjunction with the center axis 8 of the missile canister 12, define angular regions around the axis in which little space is available for ducts, and other regions in which more space is available for ducts. In FIG. 3*a*, the circumaxial regions in which little space is available between the projected missile shape (defined by outline 322MC) and the interior of the canister wall 12*o* are designated generally as CA1, CA2, CA3, and CA4. A circumaxial position is an angular position or range measured from a reference angle in a circumferential manner about a point along the axis. The projections of the missile may be viewed as substantially filling the canister volume within regions CA1, CA2, CA3, and CA4. The exhaust ducts are located in the circumaxial regions outside of regions CA1, CA2, CA3, and CA4, where the interior volume of the storage and launch duct is not fully occupied by the projected missile shape or cross-section.

As illustrated in FIG. 3*a*, six of the exhaust ducts are arranged in pairs 36*a*, 36*b*; 36*c*, 36*d*; 36*e*, 36*f*, and the last exhaust duct 36*g* is not paired. The paired exhaust ducts are mounted on each side of a longitudinally oriented I-beam rail. In particular, exhaust duct 36*a* is mounted to the right of an I-beam 350*ab* as illustrated in FIG. 3*a*, and exhaust duct 36*b* is mounted on its left. Similarly, exhaust duct 36*c* is mounted at the bottom of an I-beam 350*cd*, and exhaust duct 36*d* is mounted on its top. Exhaust duct 36*e* is mounted at the left of an I-beam 350*ef*, and exhaust duct 36*f* is mounted at its right. Lastly, exhaust duct 36*g* is mounted at the top of an I-beam 350*g*.

The outer flanges of the I-beams of FIG. 3*a* correspond to the rail mounting brackets of FIG. 1*b*. More particularly, the outer flange of I-beam 350*ab* of FIG. 3*a* is mounted to the exterior wall 12*o* of canister 12 by means of bolts, only two of which are illustrated. The outer flange of I-beam 350*ab* is designated 50*ab*, in correspondence with the designation found in FIG. 1*b*. Similarly, the outer flange 50*cd* of I-beam

350*cd* is mounted to outer wall 12*o*, and the outer flanges 50*ef* and 50*g* of I-beams 350*ef* and 350*g* are designated 50*ef* and 50*g*, respectively, and are also mounted to the exterior wall 12*o* which defines the storage and launch duct region of missile canister 12. The web of each of the I-beams is shaped to provide an area support or contact for the associated exhaust ducts rather than a line support, as would be expected if the webs were flat. More particularly, the web of each I-beam 350*ab*, 350*cd*, 350*ef*, and 350*g* includes a concave curve as seen from each side, with the curvature selected to match the exterior curvature of the associated exhaust duct. Secure mounting is promoted by the use of flexible ties looped around each pair of exhaust ducts at various locations along their lengths, and extending around at least portions of the I-beam.

Figure 3B:
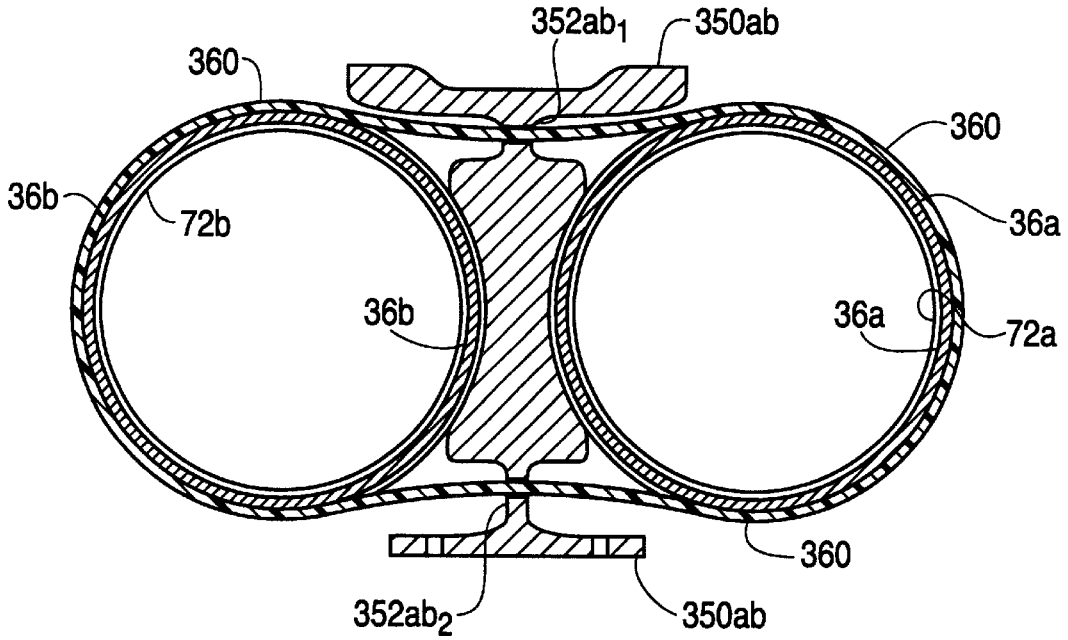
FIG. 3*b* is a simplified cross-section of a portion of the arrangement of FIG. 3*a*.

FIG. 3*b* illustrates a tie located along the length of an exhaust duct pair, tying the pair to the associated I-beam. In FIG. 3*b*, the I-beam is designated 350*ab*, and is illustrated as having a pair of apertures $\mathbf{352}ab_1$ and $\mathbf{352}ab_2$. A tie 360, formed of flexible material, such as a rope or band of Keviar or other material which is strong in tension, extends around the exterior of exhaust ducts 36*a* and 36*b* and through the apertures in I-beam 350*ab*. The tie may be fastened in any suitable manner, and may be pretensioned to aid in retaining the exhaust ducts during transportation of the self-contained missile canister and during the stresses of launch. FIG. 3*b* also shows ablative liner 72*b* and 72*a*.

Other embodiments of the invention will be apparent to those skilled in the art. For example, while seven exhaust ducts or uptake tubes have been illustrated, eight could be used in the illustrated system if there were no necessity for space for a missile umbilical. While the protective cover 18 has been described as frangible, it may be openable, dissolvable, vaporizable, or in general may be removed from the path of the missile and its exhaust in any desired manner. While the false cover of FIG. 1*e* has been described as metallic, it may be made from reinforced composite material.

Thus, a self-contained missile canister (10) according to an aspect of the invention includes a missile (40) which is elongated about an axis (8). The missile (40) has an axially projected body shape that corresponds to the missile clearance (22MC) which includes a circular portion (211) and projections (212, 216) extending beyond the radius of the circular portions (211) at plural (four) circumaxial positions. In this context, a circumaxial position is an angular position or range measured from a reference angle in a circumferential manner about a point along the axis. The self-contained missile canister (10) includes an elongated canister storage and launch duct (12*o*) defining a missile (40) exit end (14) and a rear or breech end (16). The storage and launch duct (12*o*) has a circular cross-sectional shape and a cross-sectional diameter which is larger than the largest cross-sectional diameter of the missile (40) at the projections (212, 216), whereby a plurality of elongated regions (other than CA1, CA2, CA3, and CA4) lie between the missile (40) and the interior of the storage and launch duct (120) over circumaxial regions other than the plural circumaxial positions (CA1, CA2, CA3, and CA4) of the missile (40). A plenum (13) is affixed to the breech end (16) of the canister storage and launch duct (120), for deflecting exhaust gases generated by the missile (40) within the storage and launch duct (120) during launch. A plurality of elongated, tubular exhaust ducts (set 36) lie adjacent (along) the interior of the canister storage and launch duct (120) within the circumaxial regions other than the plural circumaxial positions (CA1, CA2, CA3, CA4) of the missile (40). Each of the exhaust ducts (set 36) has a circular cross-section, and each of the exhaust ducts of set 36 is coupled to the plenum (13) for receiving the exhaust gases from the plenum (13). In addition, each of the exhaust ducts of set 36 extends from the plenum to at least near the missile (40) exit end (14) of the storage and exhaust duct (120), for routing the exhaust gases deflected by the plenum (13) to the missile (40) exit end (14) of the storage and launch duct (120). In a particular self-contained missile canister (10) according to the invention, the axially projected body shape is roughly square, thereby providing four circumaxial regions other than the plural circumaxial positions (CA1, CA2, CA3, CA4) of the missile (40).

In a particularly advantageous version of the self-contained missile canister (10) according to the invention, a plurality of elongated support beams are provided, each extending along at least a portion of the length of the storage and launch duct within one of the circumaxial regions other than the plural circumaxial positions (CA1, CA2, CA3, CA4) of the missile (40). In a desirable avatar of the invention, each of the elongated support beams supports at least one of the exhaust ducts, and preferably two exhaust ducts. The support beams are preferably I-beams defining two flanges and a web, with one of the flanges affixed to the interior wall of the storage and launch duct (12*o*). When an I-beam is used to support one or more exhaust ducts, the web of the I-beam is preferably concave on the side facing the exhaust duct being supported, so as to tend to provide an area support. In one embodiment, most of the exhaust ducts are paired for support by I-beams. To save weight, the material of the exhaust ducts may be reinforced composite material. An ablative lining may be employed with the exhaust ducts to prevent burn-through of the walls of the duct.

Taking another view of the invention, a self-contained missile (40) canister (10) includes a missile (40) having a body which has at least some cross-sections (211) which are generally circular, and which may also include cross-sections which exhibit projecting portions (212, 216) extending beyond the largest of the generally circular cross-sections, whereby a projection of the shape of the missile (40) body, approximated by missile clearance (22MC), with its projecting portions, onto a plane orthogonal to an axis of the missile (40) defines an exterior shape (322MC). An elongated canister storage and launch duct (12*o*) defines a longitudinal axis (8), a missile (40) exit end (14), and a rear or breech end (16). The storage and launch duct has a circular internal cross-sectional shape at least near the missile (40) exit end (14) which clears the exterior shape of the missile (40), whereby space (regions other than CA1, CA2, CA3, and CA4) is available between the exterior of the missile (40) and the interior of the storage and launch duct (120) at locations removed from the projecting portions. A plenum (13) is affixed to the rear or breech end (16) of the storage and launch duct (120), for deflecting exhaust gases generated by the missile (40) within the storage and launch duct (120). A plurality of elongated, tubular exhaust ducts (set 36) lie at least partially within the space (regions other than CA1, CA2, CA3, and CA4) with their axes parallel to the longitudinal axis (8) of the storage and launch canister (120). Each of the exhaust ducts is coupled to the plenum (13), and extends to at least near the missile (40) exit end (14) of the storage and launch duct (120), for routing the exhaust gases deflected by the plenum (13) to the missile (40) exit end (14) of the storage and launch duct (120). The projecting portions of the missile (40) body may include aerodynamic fins, which may be disposed by equal angular increments (900) about an axis (8) of the missile (40). Ablative material may be used within the exhaust ducts of set 36 or the entire exhaust duct may be made from ablative material. In this context, reinforced composite material may be viewed as ablative material.

What is claimed is:

1. A self-contained missile canister, comprising:

a missile which is elongated about an axis, said missile having an axially projected body shape which includes a circular portion and projections extending beyond the radius of said circular portions at plural circumaxial positions;

an elongated canister storage and launch duct defining a missile exit end and a rear or breech end, said storage and launch duct having a circular cross-sectional shape and a cross-sectional diameter which is larger than the largest cross-sectional diameter of said missile at said projections, whereby a plurality of elongated regions lie between said missile and the interior of said storage and launch duct over circumaxial regions other than said plural circumaxial positions of said missile;

a plenum affixed to said breech end of said canister storage and launch duct, for deflecting exhaust gases generated by said missile within said storage and launch duct during launch;

a plurality of elongated, tubular exhaust ducts lying along the interior of said canister storage and launch duct within said circumaxial regions other than said plural circumaxial positions of said missile, each of said exhaust ducts having a circular cross-section, and each of said exhaust ducts being coupled to said plenum for receiving said exhaust gases from said plenum, and each of said exhaust ducts extending to at least near said missile exit end of said storage and exhaust duct, for routing said exhaust gases deflected by said plenum to said missile exit end of said storage and launch duct;

a plurality of elongated support beams, each extending along at least a portion of the length of said storage and launch duct within one of said circumaxial regions other than said plural circumaxial positions of said missile;

wherein at least some of said support beams are I-beams having a cross-sectional shape including a pair of mutually parallel elongated and a web extending there between; and wherein said web includes a region having an elongated concavity.

2. A missile canister according to claim 1, wherein said axially projected body shape is roughly square thereby providing four circumaxial regions other than said plural circumaxial positions of said missile.

3. A missile canister according to claim 1, further comprising a plurality of elongated support beams, each extending along at least a portion of the length of said storage and launch duct within one of said circumaxial regions other than said plural circumaxial positions of said missile.

4. A missile canister according to claim 3, wherein at least some of said elongated support beams support plural ones of said exhaust ducts.

5. A missile canister according to claim 1, wherein said tubular exhaust ducts are made from reinforced composite material.

6. A missile canister according to claim 5, further comprising an ablative lining extending through at least a portion of the length of at least some of said tubular exhaust ducts.

7. A missile canister according to claim 1, wherein at least some of said tubular exhaust ducts are paired, and each said pair of tubular exhaust ducts is supported by an elongated beam affixed to said storage and launch duct and extending between the tubular exhaust ducts of said pair.

8. A missile canister according to claim 7, wherein at least some of said elongated beams include a web and a flange, and each of said tubular exhaust ducts of each said pair lies at least partially in an elongated cavity lying between said storage and launch duct, the web and the flange of one of said elongated beams.

9. A missile canister according to claim 8, wherein said elongated beam is an I beam including said web and said flange, and further including a second flange, said second flange being contiguous with a wall of said storage and launch duct, whereby each of said tubular exhaust ducts of each said pair lies at least partially in an elongated cavity lying between said second flange contiguous with said storage and launch duct, the web and the flange of one of said elongated beams.

10. A missile canister according to claim 1, wherein one of said tubular exhaust ducts lies against said elongated concavity.

11. A missile canister according to claim 1, wherein said tubular exhaust ducts resist exhaust pressuring in hoop tension.

12. A missile canister according to claim 1, wherein said tubular exhaust ducts contain ablative material.

* * * * *